United States Patent [19]

Miura et al.

[11] 4,427,446

[45] Jan. 24, 1984

[54] CORROSION-RESISTANT AND ABRASIVE WEAR-RESISTANT COMPOSITE MATERIAL FOR CENTRIFUGALLY CAST LININGS

[75] Inventors: Tsuyoshi Miura, Higashihiroshima; Yutaka Arakida, Hiroshima; Yoshikazu Kondo; Tsuneyuki Ide, both of Kudamatsu, all of Japan

[73] Assignees: Japan Steel Works, Ltd.; Toyo Kohan Co., Ltd., both of Tokyo, Japan

[21] Appl. No.: 253,536

[22] Filed: Apr. 13, 1981

[51] Int. Cl.[3] ..... B22F 7/02

[52] U.S. Cl. ..... 75/244; 428/547

[58] Field of Search ..... 75/228, 244; 428/547, 428/565; 164/114

[56] References Cited

U.S. PATENT DOCUMENTS

| | | | |
|---|---|---|---|
| 3,836,341 | 9/1974 | Saltzman | 138/145 |
| 3,929,181 | 12/1975 | Beyer | 164/114 |
| 3,999,952 | 12/1976 | Kondo | 75/202 |
| 4,194,900 | 3/1980 | Ide | 75/0.5 C |

FOREIGN PATENT DOCUMENTS 1512291 5/1975 United Kingdom .

*Primary Examiner*—Brooks H. Hunt
*Assistant Examiner*—Anne Brooks
*Attorney, Agent, or Firm*—Oblon, Fisher, Spivak, McClelland & Maier

[57] ABSTRACT

A corrosion- and abrasive wear-resistant composite material for use in centrifugally cast linings composed of a matrix of a metal having corrosion-resistance and an abrasive wear-resistant reinforcing material dispersed as particles in the matrix. The reinforcing material has a higher hardness and a smaller specific density than the matrix.

5 Claims, No Drawings

CORROSION-RESISTANT AND ABRASIVE WEAR-RESISTANT COMPOSITE MATERIAL FOR CENTRIFUGALLY CAST LININGS

BACKGROUND OF THE INVENTION

1. Field of the Invention

The present invention relates to a corrosion-resistant and abrasive wear-resistant composite material lining formed by centrifugal casting of sections of cylinders which are liable to corrosion and abrasion, which cylinders are used in plastics processing machines such as extruders and injection molding machines, slurry pumps, compression machines, pipes for slurry transportation, and many other similar applications.

2. Description of the Prior Art

Recently, there has been an increased demand for machinery for use in processing and transportation of fluids containing abrasive solids. For example, plastics processing machines for processing resins containing glass fiber, carbon fiber, asbestos or iron oxide; slurry pumps for fluid transportation of ore or coal; pipelines for transportation of slurries, and so forth have increasingly been demanded. Particularly, in cylinders for plastics processing machines, a metal material having corrosion-resistant and abrasive wear-resistance has been greatly desired in order to prevent corrosion from occurring during processing due to resins, additives incorporated into the resins, surface treating agents incorporated into the resins for the purpose of improving adhesion between the resins and fillers, and so forth, and to prevent abrasion due to reinforcing agents, fillers, or the like incorporated into the resins. Additionally, because fillers have been made recently with highly abrasive properties for effective utilization of resources and because an increased flame resistance of resins has been required due to the intensified application of UL Standards (UL Standards are defined in U.S.A.) associated with the increased imposition of safety regulations, corrosion-resistant and abrasive wear-resistance has increasingly been required for cylinder materials for use in plastics processing machines.

Heretofore known cylinders for plastics processing machines have been lined on the inner surface thereof with an alloy containing a large amount of iron (85% by weight or more), a nickel-cobalt based alloy or a cobalt based alloy. The former iron based alloy, however, is low in corrosion-resistance although the Vickers hardness (hereinafter referred to simply as "Hv") at room temperature in the lining state is 800 to 1000. The latter nickel-cobalt based alloy and cobalt based alloy have good corrosion-resistance, but their Hv at room temperature in the lining state is 550 to 750 and they are inferior in abrasive wear-resistance.

In order to eliminate the above defects, a composite material has been proposed in which tungsten carbide particles are dispersed in a nickel or cobalt based alloy. While the composite material has good corrosion-resistant and abrasive wear-resistance, it suffers from the following disadvantages.

The specific density of the reinforcing material, tungsten carbide, is about twice that of the nickel or cobalt based alloy matrix, and therefore, during the forming of a lining, the difference in centrifugal force resulting from the difference in specific density causes the tungsten carbide particles to be pressed more strongly than the alloy matrix against the side of the lining base material. Thus, the resulting lining is separated into a layer in contact with the lining base material in which tungsten carbide particles are dispersed densely and a layer apart from the lining base material in which no or almost no tungsten carbide particles are present. Thus in forming the corrosion-resistant and abrasive wear-resistant composite material, in which the tungsten carbide particles are dispersed in the nickel or cobalt based alloy matrix, on the inner surface of a cylinder, it is necessary to remove the said layer in which no or almost no tungsten carbide particles are present. Moreover, in controlling the boundary between the layer containing the tungsten carbide particles and the layer free from tungsten carbide particles in the vicinity of the predetermined depth from the inner surface of the lining, it is necessary to carry out the lining operation under strictly controlled conditions.

Furthermore, since the tungsten carbide particles congregate at the interface between the lining base material and the lining layer, the adhesion strength between the lining base material and the lining layer is low and the lining layer is easily stripped off. The tungsten carbide particles-containing layer per se has good abrasive wear-resistance but has a tendency to wear away any metal material which may come into contact therewith such as a screw. In addition, tungsten is expensive and its supply is uncertain.

SUMMARY OF THE INVENTION

An object of the invention is thus to provide a corrosion-resistant and abrasive wear-resistant composite material lining formed by centrifugal casting which is free from the above-described defects encountered with conventional materials.

The above object is attained by employing as a matrix a metal having corrosion-resistance and by dispersing therein particles of a reinforcing material which is nearly equal in hardness to tungsten carbide and which has a lower specific density than the matrix.

Broadly, the invention comprehends a corrosion-resistant and abrasive wear-resistant composite material lining formed by centrifugal casting which is composed of a matrix of a metal having corrosion-resistance and reinforcing material particles dispersed therein. The reinforcing material has a high hardness and a lower specific density than the matrix.

DESCRIPTION OF THE PREFERRED EMBODIMENTS

As the matrix metal having corrosion-resistance, a nickel or cobalt based alloy having corrosion-resistance is used, and as the reinforcing material, there is used a boride or a composite boride which is composed mainly of chromium or iron and boron and which has a hardness nearly equal to that of tungsten carbide and the specific density of which is lower than that of the matrix and one-third to one-half that of tungsten carbide. Lining a cylinder with the composite material provides a marked prolonging of the life of the cylinder and other structures to which it is applied.

Hereinafter the invention will be explained in greater detail by reference to specific examples.

In a preferred embodiment of the invention, the reinforcing material of the composite material is a chromium boride, an iron boride, or a composite boride containing at least 20% by weight, preferably at least 30% by weight, of an iron element, as prepared by replacing a part of the iron boride by a boride of a non-ferrous element or a composite boride of a non-ferrous element; a nickel based alloy containing 0.5 to 4.0% by weight of B, 1.0 to 5.0% by weight of Si, 0.2 to 1.0% by weight of C, 16% by weight or less of Cr, 4% by weight or less of Fe, and the remainder of Ni, or a cobalt based alloy containing 0.5 to 4.0% by weight of B, 1.0 to 5.0% by weight of Si, 4.0 to 12% by weight of W, 0.2 to 1.0% by weight of C, 16% by weight or less of Cr, 12% by weight or less of Ni, and the remainder of Co is used as the matrix. The reinforcing material is incorporated into the matrix in an amount of 20 to 50% by weight, preferably 30 to 45% by weight, based upon the composite material.

The Hv of the reinforcing material is 1,300 to 2,000, which is nearly equal to that of tungsten carbide, and the specific density is about 5.6 to 7.5, which is about one-third to one-half that of tungsten carbide.

The matrix used in this invention is either a Ni-Cr-B-Si based self-fluxing alloy or a Co-Ni-Cr-W-B-Si based self-fluxing alloy. Both matrices have a high Ni, Cr or Co content and have excellent corrosion-resistance. Furthermore, since the matrix material of this type have a boride and a carbide deposit, they have an Hv of 450 to 800 and good abrasive wear-resistance. The specific densities of the matrices are about 8 to 9, which is higher than that of the reinforcing material.

In more detail, as the reinforcing material are used chromium boride, iron boride, iron-chromium composite boride, multi-element composite boride, for example, iron-chromium-X-boride, iron-X-boride (wherein X is a boride-forming element other than iron, chromium and boron), and alloys containing as a main constituent such borides. By multi-element composite boride, such as iron-chromium-X-boride and/or iron X-boride, as used herein is meant a composite boride containing 3 to 20% by weight of B, less than 3% by weight of Al, less than 5% by weight of Si, less than 2.5% by weight of oxygen, less than 2.0% by weight of C, and at least one boride-forming metal selected from the group consisting of Cr, Mo, W, Ti, V, Nb, Ta, Hf, Zr, Co, Ni and Mn, in the following amounts: 0.5 to 35% by weight of Cr, 0.5 to 35% by weight of Mo, 1 to 30% by weight of W and less than 15% by weight of each Ti, V, Nb, Ta, Hf, Zr, Co, Ni and Mn, the balance being at least 20% by weight of Fe. When the boron content is less than 3% by weight, the hardness of the multi-element composite boride does not reach the desired high level. Accordingly, the lower limit of boron content is 3% by weight, preferably 5% by weight. In contrast, if the boron content is too high, the multi-element boride becomes brittle. Accordingly, it is specified that the upper limit of the boron content is 20% by weight, preferably 16% by weight.

Cr forms a stable and hard boride; for example, the Hv of $Cr_2B$ is about 1800, and that of CrB is about 1200 to 2000.

The Cr boride also improves the corrosion resistance and oxidation resistance comparable to that of stainless steel or heat resistant steel, and its hardness is further enhanced, and its high hardness and high toughness can be maintained, even at high temperatures. The preferable content of Cr is 0.5 to 35% by weight. When the Cr content is less than 0.5% by weight, the foregoing effect is poor. In contrast, when the Cr content exceeds 35% by weight, the increase in effect due to Cr becomes small.

Mo and W make stable borides not only at room temperature but also at elevated temperatures, and moreover, the hardness of their borides is very high, for example, the Hv of $Mo_2B$ is about 1660, that of MoB is about 1750 to 2350, that of $W_2B$ is about 2420 and that of WB is about 3750. When W and/or Mo are included in a multi-element composite boride, the resulting composite material has good wear resistance.

The Mo content is 0.5 to 35% by weight, and preferably 5 to 30% by weight. When the Mo content is less than 0.5% by weight, the foregoing effect of Mo is not remarkable. In contrast, if the Mo content is beyond 35% by weight, heat resistance and oxidation resistance become inferior.

The W content is 1 to 30% by weight. If the W content is less than 1% by weight, the foregoing effect of W is not remarkable. Since the world W resources are now decreasing, increasing the W content in the multi-element boride makes it costly. Therefore, the upper limit of the W content is 30% by weight, preferably 20% by weight. When Co is included in a multi-element boride, it makes a stable boride, and therefore, the wear resistance will be improved. The influence of Ni is similar to that of Co. Ti, V, Nb, Ta, Hf and Zr are metals of Group IV-a or V-a of the Periodic Table, and all make multi-element composite borides stable when they are included in the borides. For example, the Hv of TiB is about 2700 to 2800, and that of $VB_2$ is about 2080 to 2800. If suitable amounts of Ti, V, Nb, Hf, Ta and Zr are present in a multi-element composite boride, the wear at room temperature but also resistance is improved not only at elevated temperatures. The Co content in the multi-element boride is less than 15% by weight. When the Co content is too high, crystals grow very fast during centrifugal casting of linings with the result that the multi-element boride becomes brittle. The influence of Ni and Mn is similar to that of Co, and the amount of each of Ni and Mn is less than 15% by weight. Each of Ti, V, Nb, Ta, Hf and Zr is employed in an amount of less than 15% by weight. When each of the Ti, V, Nb, Ta, Hf and Zr contents is too high, the multi-element boride becomes brittle. It was found that the limiting of the amount of Al, Si, oxygen and C in a multi-element composite boride is very important to give a superior strength to the multi-element composite boride. Moreover, by limiting these elements, the wettability between the matrix particles and the reinforcing materials is improved during the lining process. Al which is present in this multi-element composite boride seems to be combined with boron and oxygen during the lining process and therefore it makes the wettability between the matrix particles and the reinforcing materials poor. The Al content in the multi-element composite boride is less than 3% by weight, preferably less than 1% by weight. When C is present in the multi-element composite boride, it combines with oxygen during the lining process to form CO or $CO_2$ gas, and then this CO or $CO_2$ gas causes micropores in the composite material. Therefore, the C content in the multi-element composite boride should be kept at less than 2% by weight, preferably less than 1% by weight. Oxygen combines with Al, C and other metals which are contained in the multi-element composite boride such as Cr, Ti, V, Nb and so forth, to form oxides, which oxides then make the composite material brittle. Accordingly, the oxygen content in the multi-element composite boride must be kept at less than 2.5% by weight. Si which is present in the multi-element composite boride seems to combine with oxygen during the lining process and therefore it makes wettability between matrix particles and reinforcing materials poor. Accordingly, the Si content in the multi-element composite boride must be kept at less than 5% by weight, preferably less than 3% by weight.

The melting point of the reinforcing material of the invention is higher than that of the matrix. Therefore, at a lining formation temperature of 950° to 1,250° C., the reinforcing material partly melts or does not melt at all. However, since the reinforcing material reacts with the matrix in the interface therebetween, the reinforcing material in the vicinity of the interface melts slightly. This melting increases the adhesion strength between the reinforcing material and the matrix thereby alleviating those problems generally arising with composite materials, as is the case with composite materials with tungsten carbide incorporated thereinto, such as peeling of the reinforcing material resulting from an insufficient adhesion strength between the matrix and the reinforcing material, propagation of cracks along the interface between the matrix and the reinforcing material, and the like.

By lining the inner surface of a cylinder with the composite material of this invention, the following lining layer is obtained. Owing to the difference in centrifugal force resulting from the difference in specific density, the reinforcing material lighter than the matrix congregates at the inner surface of the lining layer far from the lining base material, whereas very little if any reinforcing material is present in a portion of the lining layer near the lining base material. Thus, the reinforcing material is dispersed in the matrix forming a density distribution gradient in the direction of thickness in the lining layer. The manner of dispersion varies depending upon the composition of the composite material and lining conditions such as temperature, centrifugal force used, and the like. Centrifugal casting of a lining a cylinder using the composite material of the invention permits a very hard and excellent abrasive wear-resistant reinforcing material to congregate in the inner surface of the lined cylinder, whereby a lined cylinder having good corrosion-resistance and abrasive wear-resistance can be obtained.

On the other hand, in the case of a centrifugal casting of a lining with the composite material having tungsten carbide incorporated thereinto, a layer containing no tungsten carbide is formed in the surface of the lining layer because the specific density of the tungsten carbide is greater than that of the matrix. It is therefore necessary to remove the unnecessary layer containing no tungsten carbide in order to obtain a cylinder inner surface having the desired corrosion-resistant and abrasive wear-resistance. Such a removal step is not necessary in the centrifugal casting of with the composite material lining of the invention.

Furthermore, in a cylinder lined with the composite material having tungsten carbide incorporated thereinto, tungsten carbide particles congregate at the interface between the lining base material and the lining layer, thereby lowering the adhesion strength between the lining base material and the lining layer. In some cases, the lining layer is stripped from the lining base material. On the other hand, for a lined cylinder prepared using the composite material of the invention, the adhesion strength between the lining base material and the lining layer is markedly improved because little, if any, of the reinforcing material is present in the boundary therebetween.

The primary constituent of the reinforcing material for use in the composite material of this invention is a boride containing Cr and/or Fe. This material is readily and abundantly available. The composite material of this invention, therefore, can be produced with ease and at low cost in comparison with composite material using tungsten carbide as the reinforcing material. As can be seen from the abrasive wear test results illustrated in Table 2 which will hereinafter be explained, the composite material of this invention has excellent abrasive wear-resistance by itself and furthermore has the advantageous characteristic that a material in sliding contact therewith wears only very slowly.

The reasons why the content of the reinforcing material in the composite material of this invention is limited to 20 to 50% by weight, preferably 30 to 45% by weight, are as follows:

When the content of the reinforcing material is less than 20% by weight, the hardness is insufficient. In amounts greater than 50% by weight, the matrix cannot hold the reinforcing material in the dispersion state or the matrix will not melt and it becomes impossible to form the lining layer.

The iron content in the boride used as the reinforcing material is at least 20% by weight, preferably at least 30% by weight. The reason for this is that the composite boride containing iron has a sufficiently high hardness and when chromium, etc. are added thereto in suitable amounts, the resulting composite boride has excellent corrosion- and abrasive wear-resistance similar to those of stainless steel. Furthermore, boride powder containing iron as a major ingredient is readily available commercially and iron is abundant and inexpensive.

The reason why the composition of the matrix is selected as described hereinbefore is that the matrix having such composition reacts with the reinforcing material at the lining temperature and slightly melts in the vicinity of the interface, whereby the adhesion strength between the matrix and the reinforcing material is markedly increased and the corrosion-resistant and abrasive wear-resistance are excellent.

In the Ni-Cr-B-Si based self-fluxing alloy matrix, both of B and Si are added to impart self-fluxing to the matrix alloy. Where B is in an amount of less than 0.5% by weight and Si is in an amount of less than 1.0% by weight, no self-fluxing is obtained.

By the term "self-fluxing" as used herein is meant that an oxide formed when the alloy or other materials are heated or melted satisfies the following requirements: (1) the oxide has a low melting point, (2) the oxide forms a thin and strong protective film to prevent excessive oxidation of the melted alloy or other materials, and (3) the separation of the oxide from the melted alloy or other materials is easy.

In accordance with this invention, the alloy matrix must be provided with self-fluxing for the following reasons.

In a melt-lining process for forming the composite material of this invention, a small cylinder can be lined by melting the mixture of the reinforcing material powder and matrix powder under vacuum or in an inert gas atmosphere so that no oxidation of the melted metal occurs although such a procedure may be expensive. However, melt-lining of a large cylinder in an oxidation-preventing atmosphere is very difficult and very expensive, and such a large cylinder is usually subjected to melt-lining in the atmosphere. In accordance with the invention, therefore, it is necessary to provide the lining alloy with self-fluxing, taking into account the case where the composite material is formed in a melt-lining process in the atmosphere.

On the other hand, where the amounts of B and Si exceed 4.0% by weight and 5.0% by weight, respectively, the brittleness of the lining alloy increases resulting in a reduction in mechanical properties, and cracking and stripping of the lining layer. Thus, the specific characteristics are greatly deteriorated. Therefore, the amounts of B and Si should be in the ranges of 0.5 to 4.0% by weight and 1.0 to 5.0% by weight, respectively. Within these ranges, B is effective in lowering the melting point of the alloy matrix, simplifying the lining operation, and forming a boride or eutectic product to increase the hardness. Si also has an effect of improving the fluidity of the alloy matrix at the stage of melting and furthermore an effect of improving the mechanical properties.

Cr is added to provide the alloy matrix with corrosion-resistance and to form the boride or carbide, providing abrasive wear-resistance for the matrix alloy. However, since the addition of an excessive amount of Cr increases the melting point of the matrix alloy and makes the lining operation difficult, the upper limit of the Cr content is 16% by weight.

Iron is added to provide the matrix alloy with corrosion-resistance. However, since it forms an Fe-Ni solid solution having a low hardness which lowers the hardness of the matrix alloy, the upper limit of the iron content is 4% by weight.

C is added to form a carbide and impart abrasive wear-resistance. When the C content is less than 0.2% by weight, the formation of the carbide is insufficient and the abrasive wear-resistance deteriorates. On the other hand, when it exceeds 1.0% by weight, the corrosion-resistance of the alloy matrix deteriorates. Therefore, the C content is 0.2 to 1.0% by weight.

The remainder of the alloy is Ni which is added to provide the alloy matrix with corrosion-resistance.

Next, in the case of the Co-Ni-Cr-W-B-Si based self-fluxing alloy matrix, the B, Si, Cr and C contents are determined for the same reasons as described for the Ni-Cr-B-Si based self-fluxing alloy.

W is added to form a boride and a carbide, providing the alloy matrix with corrosion-resistant and abrasive wear-resistance. When the W content is less than 4.0% by weight, such characteristics cannot be imparted. On the other hand, when it is greater than 12% by weight, the primary crystals of the carbide become large, markedly wearing a material which is in sliding contact. Therefore, the W content is 4.0 to 12% by weight.

Ni is added to provide the alloy matrix with corrosion-resistance, but it tends to markedly lower the hardness of the alloy matrix. Therefore the upper limit of the Ni content is 12% by weight.

The remainder of the alloy is Co, which is added in combination with Cr and B to provide the alloy matrix with high hardness characteristics and corrosion-resistance.

Hereinafter a process for the production of the composite material of this invention and a process for the production of a lined cylinder formed by the composite material are explained.

In order to achieve a uniform dispersion of the reinforcing material in the longitudinal direction of the lining cylinder, the matrix material and the reinforcing material are mixed each in a powder state at room temperature. Being selected from chromium boride, iron boride, iron-chromium boride and multielement composite boride, at least one boride is blended as the reinforcing material. Granulation of these materials is carried out by a so-called water-atomizing process or gas-atomizing process wherein a molten alloy containing the desired elements is drawn out from fine holes and finely granulated by a high pressure water flow or an argon or nitrogen gas flow ejected from a nozzle. While the water-atomizing process and gas-atomizing process can be employed because they are commercially advantageous, other suitable processes for the production of powder can be employed.

The resulting powder mixture is introduced into a cylinder to be lined in an amount sufficient to obtain a desired thickness and both ends of the cylinder are covered. Thereafter, the cylinder is placed in a furnace and heated to a temperature of about 950° to 1,250° C., which is somewhat higher than the temperature at which the matrix melts. The cylinder is then taken out from the furnace and is cooled while rotating in other to centrifugally form a composite material lining. After the lining material solidifies and melt-adheres, the cylinder is gradually cooled in the furnace or in diatomaceous earth. After the cylinder is completely cooled, the covers are removed from both ends and the cylinder is finished to a predetermined cylinder inner diameter dimension. For the finishing operation, it is impossible to cut and grind with the usual tools since the very hard reinforcing material is densely present in the vicinity of the inner surface of the cylinder. However, the use of tools made mainly of cubic boron nitride permits cutting and grinding of the cylinder so lined.

The following specific examples are given to illustrate the invention in greater detail.

Two kinds of reinforcing materials and four kinds of matrix materials used in the examples were prepared as follows: An alloy composition within the scope of this invention was mixed in a graphite crucible and melted in a high frequency electric furnace and the resulting molten alloy was granulated by the water-atomizing process to provide powder under 48 mesh. Analytical results are shown in Table 1.

TABLE 1

| | Composition (% by weight) | | | | | | | | Hardness | |
|---|---|---|---|---|---|---|---|---|---|---|
| | C | Si | B | Ni | Cr | Fe | Co | W | (Hv) | Remarks |
| Reinforcing Material | | | | | | | | | | |
| R-1 | — | — | 9.74 | — | 13.6 | Bal | — | — | 1400 to 1800 | (Fe—Cr)boride |
| R-2 | — | — | 29.5 | — | Bal | — | — | — | 1550 to 1940 | Cr boride |
| Matrix Material | | | | | | | | | | |
| M-1 | 0.42 | 3.75 | 2.15 | Bal | 10.9 | 2.65 | — | — | 510 to 580 | Ni—Cr—B—Si based self-fluxing alloy |

TABLE 1-continued

| | Composition (% by weight) | | | | | | | | Hardness | |
|---|---|---|---|---|---|---|---|---|---|---|
| | C | Si | B | Ni | Cr | Fe | Co | W | (Hv) | Remarks |
| M-2 | 0.72 | 4.10 | 2.45 | Bal | 14.5 | 3.5 | — | — | 655 to 745 | Ni—Cr—B—Si based self-fluxing alloy |
| M-3 | 0.53 | 4.33 | 3.04 | Bal | 13.0 | 1.42 | — | — | 655 to 700 | Ni—Cr—B—Si based self-fluxing alloy |
| M-4 | 0.98 | 2.50 | 1.53 | 12.0 | 15.8 | — | Bal | 9.05 | 490 to 550 | Co—Ni—Cr—W—B—Si based self-fluxing alloy |

EXAMPLE 1

The reinforcing material R-1 powder and the matrix material M-1 powder were compounded in a ratio of 30:70 (% by weight) and fully mixed. The mixture was introduced into a SCM 4 cylinder (SCM 4 refers to chromium-molybdenum steel as defined in JIS G 4105) with an outer diameter of 88 mm and an inner diameter of 47 mm in an amount sufficient to provide a lining layer of a thickness of 1.5 mm. After sealing both ends of the cylinder with SCM 4 lids, the cylinder was placed in a furnace maintained at about 1100° C. and heated for 40 minutes. Then the cylinder was taken out of the furnace, immediately placed in a centrifuge, and rotated at 1730 rpm.

After cooling the cylinder to 830° C., the rotation was stopped and the cylinder was gradually cooled in diatomaceous earth for 72 hours. Thereafter, the lids were removed and the lining layer thus formed was inspected.

The lining layer had a thickness of 1.5 mm and diffusion-melt adhered to the inner surface of the SCM 4 cylinder. The reinforcing material particles were densely present in the vicinity of the surface of the lining layer, almost to reinforcing material particles were dispersed in the vicinity of the lining base material, and the Hv of the lining surface was 850 to 1000.

EXAMPLE 2

The reinforcing material R-1 powder and the matrix material M-1 powder were compounded in a ratio of 35:65 (% by weight) and fully mixed. Using the mixture thus prepared, the procedure of Example 1 was repeated.

The lining layer had a thickness of 1.5 mm and diffusion-melt adhered to the inner walls of the SCM 4 cylinder. The reinforcing material particles were densely present in the vicinity of the surface of the lining layer, almost no reinforcing material particles were dispersed in the vicinity of the lining base material, and the Hv of the lining surface was 950 to 1200.

EXAMPLE 3

The reinforcing material R-1 powder and the matrix material R-1 powder were compounded in a ratio of 45:55 (% by weight) and fully mixed. Using the mixture thus prepared, the procedure of Example 1 was repeated.

The lining layer had a thickness of 1.5 mm and diffusion-melt adhered to the inner walls of the SCM 4 cylinder. The reinforcing material particles were densely present in the vicinity of the lining layer, almost no reinforcing material particles were dispersed in the vicinity of the lining base material, and the Hv of the lining surface was 1000 to 1400.

EXAMPLE 4

The reinforcing material R-2 powder and the matrix material M-1 powder were compounded in a ratio of 35:65 (% by weight) and fully mixed. Using the mixture thus prepared, the procedure of Example 1 was repeated.

The lining layer had a thickness of 1.5 mm and diffusion-melt adhered to the inner walls of the SCM 4 cylinder. The reinforcing material particles were densely present in the vicinity of the surface of the lining layer, almost no reinforcing material particles were dispersed in the vicinity of the lining base material, and the Hv of the lining surface was 1,000 to 1,450.

EXAMPLE 5

The reinforcing material R-1 powder and the matrix material M-2 powder were compounded in a ratio of 35:65 (% by weight) and fully mixed. Using the mixture thus prepared, the procedure of Example 1 was repeated, except that the temperature of the furnace was about 1,050° C.

The lining layer had a thickness of 1.5 mm and diffusion-melt adhered to the inner walls of the SCM 4 cylinder. The reinforcing material particles were densely present in the vicinity of the surface of the lining layer, almost no reinforcing material particles were dispersed in the vicinity of the lining base material, and the Hv of the lining surface was 980 to 1190.

EXAMPLE 6

The reinforcing material R-1 powder and the matrix material M-3 powder were compounded in a ratio of 35:65 (% by weight) and fully mixed. Using the mixture thus prepared, the procedure of Example 5 was repeated.

The lining layer had a thickness of 1.5 mm and diffusion-melt adhered to the inner walls of the SCM 4 cylinder. The reinforcing material particles were densely present in the vicinity of the surface of the lining layer, almost no reinforcing material particles were dispersed in the vicinity of the lining base material, and the Hv of the lining surface was 930 to 1150.

EXAMPLE 7

The reinforcing material R-1 powder and the matrix material M-4 powder were compounded in a ratio of 35:65 (% by weight) and fully mixed. Using the mixture thus prepared, the procedure of Example 1 was repeated.

The lining layer had a thickness of 1.5 mm and diffusion-melt adhered to the inner walls of the SCM 4 cylinder. The reinforcing material particles were densely present in the vicinity of the surface of the lining layer, almost no reinforcing material particles were dispersed in the vicinity of the lining base material, and the Hv of the lining surface was 800 to 1050.

The hardness, wear-resistance and corrosion-resistance in each of the Examples described above are shown in Table 2 together with those for the conventional centrifugally cast lined cylinders.

TABLE 2

| | Run No. | Composition (% by weight) Matrix C | Si | B | Mn | Ni | Cr | Co | Fe | W | Reinforcing material | Hardness (Hv) | Wear-resistance Ring volume loss ($mm^3$) | Plate volume loss ($mm^3$) | Corrosion rate (ipy) |
|---|---|---|---|---|---|---|---|---|---|---|---|---|---|---|---|
| Conventional products | 1 | 3.27 | 1.03 | 1.01 | 1.56 | 4.32 | 1.15 | 0.11 | Bal | — | — | 660 | 1.52 | 0.56 | 0.54 |
| | 2 | 0.05 | 1.37 | 3.24 | 1.02 | 39.8 | 6.87 | Bal | — | — | — | 487 | 1.40 | 0.86 | 0.037 |
| | 3 | — | 1.10 | 2.78 | 1.10 | 0.80 | 7.15 | Bal | 0.85 | — | — | 650 | 1.20 | 0.45 | 0.040 |
| | 4 | — | 2.70 | 1.72 | — | Bal | — | 6.00 | 1.95 | — | WC 44.6 | 800–1100 | 1.52 | 0.16 | 0.054 |
| Products of this invention | 5 | | | | M-1 | 65 | | | | | R-1 35 | 950–1200 | 0.05 | 0.17 | 0.058 |
| | 6 | | | | M-2 | 65 | | | | | R-1 35 | 980–1190 | 0.46 | 0.12 | 0.048 |
| | 7 | | | | M-3 | 65 | | | | | R-1 35 | 930–1150 | 1.28 | 0.15 | 0.065 |
| | 8 | | | | M-4 | 65 | | | | | R-1 35 | 800–1050 | 0.82 | 0.20 | 0.046 |

The wear tests were carried out as follows. A plate test piece was slid while being pushed onto a rotating ring (diameter 30 mm×width 3 mm, SUS 440C, Hv 600). The wear volume loss of the ring was calculated by converting the difference in weight before and after the testing into a volume. The wear volume loss of the plate test piece was determined geometrically from the width of wear scar formed on the sliding surface. The wear test conditions were a sliding speed of 0.46 m/sec, a sliding distance of 200 m, a pushing load of 18.9 kg, room temperature and no lubricant.

The corrosion tests were carried out as follows: A 10×20×1 mm plate test piece was soaked in 50 vol% hydrochloric acid at room temperature and atmospheric pressure for 100 hours. The corrosion rate was calculated from the difference in weight of the test piece before and after the testing.

As can be seen from the results shown in Table 2, the nickel base layer of this invention is markedly superior in hardness, wear-resistance and corrosion-resistance to the hitherto known high iron content alloy, nickel-cobalt based alloy and cobalt based alloy lining layers. Furthermore, it is nearly equal or somewhat superior in hardness, wear-resistance and corrosion-resistance to the lining layer of the composite material having tungsten carbide incorporated thereinto. In addition, as can be seen from the wear test, the lining layer of this invention has the advantage that a material in sliding contact therewith wears less.

As can now be readily appreciated, the corrosion-resistant and abrasive wear-resistant composite material of the invention has excellent wear-resistance and corrosion-resistance. In particular, since the reinforcing material constituting the composition has a smaller specific density than the other component, matrix, namely, nickel or cobalt based alloy, the composite material of this invention is suitable for forming centrifugally cast lining. Furthermore, the composite material of this invention has the advantage that materials coming into sliding contact therewith suffer less wear. In addition, this invention has the advantages that the production cost of the composite material is lower than conventional materials having tungsten carbide incorporated thereinto as a reinforcing material, and the production of the composite material is easy.

We claim:

1. A corrosion-resistant and abrasive wear-resistant composite material lining for a substrate, said lining formed by centrifugal casting and comprising a metal matrix and reinforcing materials, said matrix selected from the group consisting of a Ni-based self-fluxing alloy and a Co-based self-fluxing alloy, wherein said Ni-based self-fluxing alloy consists of 0.5–4.0% by weight of B 1.0–5.0% by weight of Si, 0.2–1.0% by weight of C, up to 16% by weight of Cr, up to 4% by weight of Fe, and the remainder Ni and wherein said Co-based self-fluxing alloy consists of 0.5–4.0% by weight of B, 1.0–5.0% by weight of Si, 4.0–12% by weight of W, 0.2–1.0% by weight of C, up to 16% by weight of Cr, up to 12% by weight of Ni and the remainder Co; said reinforcing material is selected from the group consisting of chromium boride, iron boride and composite boride wherein said composite boride comprises 3–20% by weight of B, less than 3% by weight of Al, less than 5% by weight of Si, less than 2.5% by weight of oxygen, less than 2.0% by weight of C and at least one metal selected from the group consisting of Cr, Mo, W, Ti, V, Mb, Ta, Hf, Zr, Co, Mi and Mn in the following amounts 0.5–35% by weight of Cr, 0.5–35% by weight of Mo, 1–30% by weight of W and less than 15% by weight of each of Ti, V, Mb, Ta, Hf, Zr, Co, Ni and Mn; the balance being at least 20% by weight of Fe; wherein said reinforcing material substantially congregates at the surface of the lining distant from the substrate.

2. The composite material lining as claimed in claim 1, wherein said reinforcing material is composite boride.

3. The composite material lining as claimed in claim 2, wherein said composite boride comprises from 0.5 to 35% by weight of Cr to improve the corrosion resistance of the composite material.

4. The composite material lining as claimed in claim 1, wherein said reinforcing material is chromium boride.

5. The composite material lining as claimed in claim 4, wherein said chromium boride consists of CrB, $Cr_2B$ or a combination thereof.

* * * * *

UNITED STATES PATENT AND TRADEMARK OFFICE

CERTIFICATE OF CORRECTION

PATENT NO. : 4,427,446

DATED : JANUARY 24, 1984

INVENTOR(S) : TSUYOSHI MIURA ET AL

It is certified that error appears in the above-identified patent and that said Letters Patent is hereby corrected as shown below:

| COL. | LINE | |
|---|---|---|
| | | Title Page, Item [73], before "Japan", please insert --The--. |
| 12 | 42&45 | Change "Mb", each occurrence, to --Nb--. |
| 12 | 42 | Change "Mi" to --Ni--. |

Signed and Sealed this

*Twentieth* Day of *November 1984*

[SEAL]

*Attest:*

GERALD J. MOSSINGHOFF

*Attesting Officer*

*Commissioner of Patents and Trademarks*